United States Patent [19]

Ugalde

[11] Patent Number: 4,491,375

[45] Date of Patent: Jan. 1, 1985

[54] COMPUTER WORK STATION CABINET

[76] Inventor: Carlos V. Ugalde, 1150 E. Service Ave., West Covina, Calif. 91790

[21] Appl. No.: 519,046

[22] Filed: Aug. 1, 1983

[51] Int. Cl.[3] ..... A47B 88/06

[52] U.S. Cl. ..... 312/250; 312/320; 312/322; 312/283

[58] Field of Search ..... 312/100, 256, 251, 320, 312/322, 323, 326, 283, 194, 196; 206/387

[56] References Cited

U.S. PATENT DOCUMENTS

| | | | |
|---|---|---|---|
| 690,352 | 12/1901 | Boykin | 312/222 |
| 729,180 | 5/1903 | Hunter | 312/323 |
| 3,712,667 | 1/1973 | Weber | 312/250 |
| 3,936,106 | 2/1976 | Harper | 312/250 |
| 3,988,802 | 11/1976 | Bruni et al. | 312/320 |
| 4,026,616 | 5/1977 | Kuehl | 312/250 |
| 4,073,556 | 2/1978 | Wilson, Jr. | 312/250 |
| 4,114,965 | 9/1978 | Oye et al. | 312/250 |
| 4,314,734 | 2/1982 | Grunert | 312/322 |
| 4,369,763 | 1/1983 | Sullivan | 312/250 |
| 4,401,216 | 8/1983 | Koch | 206/387 |

FOREIGN PATENT DOCUMENTS

| | | | |
|---|---|---|---|
| 1007804 | 4/1948 | France | 312/322 |

OTHER PUBLICATIONS

McGarvey Storage Cart for a Videotex Computer Terminal 7/1981, p. 25.

*Primary Examiner*—Victor N. Sakran
*Assistant Examiner*—Joseph Falk
*Attorney, Agent, or Firm*—Boniard I. Brown

[57] ABSTRACT

A roll around cabinet having a top at appropriate height for supporting a computer CRT at a comfortable reading height for an operator seated at the cabinet, a lockable front door behind which a keyboard component drawer is slideably mounted for extension when the front door is opened, and a side drawer assembly with a lockable side door which when unlocked allows the drawer assembly to be rolled sidewardly out of the cabinet to give access to a plurality of shelves supported thereby. Pins are provided on the drawer assembly adjacent the door thereof which engage the cabinet to prevent unauthorized access by spreading the cabinet front and back. Another pin is provided in the rear of the assembly which engages a pin hook when the drawer assembly is fully extended so that the assembly remains with the cabinet but can be pivoted through a substantial angle for easy access to its shelves by the operator at the keyboard.

19 Claims, 10 Drawing Figures

COMPUTER WORK STATION CABINET

BACKGROUND OF THE INVENTION

Stand-alone computers for word-processing and other computer chores are becoming increasingly popular. Such systems usually consist of a cathode ray tube (CRT) display, a central processing unit (CPU) cabinet, a disk or tape data storage device, a keyboard and a printer. Other devices such as telephone modems, optical character readers, joy sticks, and voice synthesizers may also be included. In addition, software and manuals normally are stored in close association with the computer system. Heretofore, conventional office equipment such as desks, tables, chairs, bookcases and stands have been adapted to support the various components of small computer systems. Unfortunately, conventional furniture does not provide the desired operator convenience and comfort nor is it suitable to protecting the high-value components or sensitive data from theft. In some instances it is desirable to be able to move the complete computer system from one place to another without disassembly, and conventional office furniture cannot accommodate this need. Therefore, there has been a need to provide a cabinet in which the high-value thievable components and software of a small stand-alone computer system can be stored and transported which also provides a comfortable and convenient work station allowing easy access to the various components of the computer system.

BRIEF DESCRIPTION OF THE PRESENT INVENTION

In the present invention a cabinet is provided in which all components of a small stand-alone computer system can be secured except the CRT Display. The cabinet includes a top shelf at the correct height for supporting the CRT display for use by a seated operator. The cabinet is equipped with castering rollers so that it can be moved from place-to-place conveniently. In the front, a lockable front door is hingedly connected to swing downwardly out of the way so that a front drawer may be slid out of the cabinet to position a keyboard of the computer system supported thereby for use. A lockable side drawer assembly is also provided which can roll out the side of the cabinet on its own castering rollers and can be swung toward the operator so that a printer, tape or disk drives, the CPU if separate from the keyboard, and other components as well as stored software and manuals are readily available to the operator on shelves thereof. Suitable engagement pins, cams, and a pivot hook are provided between the main cabinet and its side drawer assembly so that when positioned within the cabinet, the side drawer closes the cabinet completely on the side and bottom to prevent pilferage.

Therefore it is an object of the present invention to provide a lockable cabinet for storing the high-value thievable components and software of a stand-alone computer system while being capable of supporting the components of the computer system in proper position for use.

Another object is to provide a computer cabinet which is configured to make components stored therein readily accessible to an authorized user.

Another object is to provide a computer storage work station cabinet which is stable no matter what the operating configuration thereof.

Another object is to provide a computer storage and work station cabinet which can be easily constructed from readily available supplies and materials and which can be adapted to both left and right hand users.

These and other objects and advantages of the present invention will become apparent to those skilled in the art after considering the following detailed specification along with the accompanying drawings wherein:

DETAILED DESCRIPTION OF THE SHOWN EMBODIMENT

Figure 1:
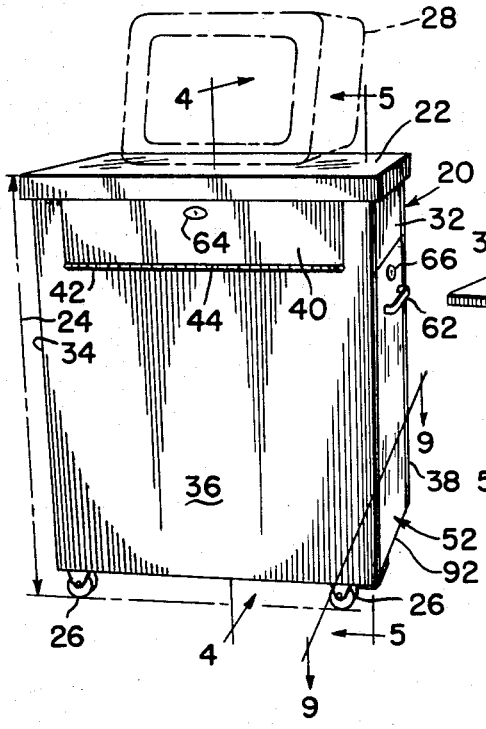
FIG. 1 is a perspective front view of the computer cabinet of the present invention locked and ready for movement to a new location.

Referring to the drawings more particularly by reference numbers, number 20 in FIG. 1 refers to a computer work station cabinet constructed according to the present invention. The cabinet 20 will be described as a right hand cabinet although the description is meant to cover a right/left mirror image cabinet as well. The cabinet 20 includes a top shelf 22 an appropriate height 24 above cabinet supporting castered rollers 26 rolling on the ground 27 so that a cathode ray tube (CRT) display 28 can be placed thereon and be at a suitable height for an operator seated at the cabinet 20. The shelf 22 is supported from the castered cabinet rollers 26 by a cabinet enclosure 30 which has right and left sides 32 and 34 and front and back sides 36 and 38.

Figure 2:
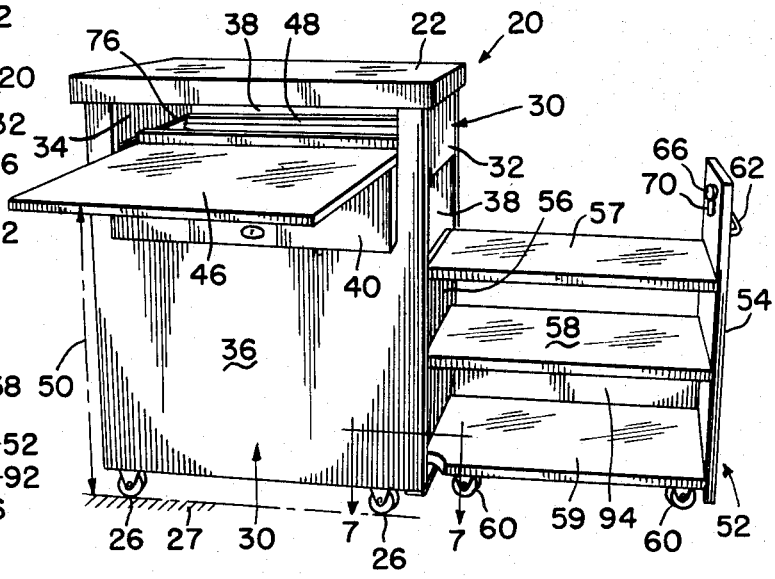
FIG. 2 is a front perspective view of the cabinet of FIG. 1 with its front drawer and side drawer assembly deployed.

A front door 40 is provided in the front side 36 and is connected thereto by a hinge 42 at its lower edge 44 so that it can be swung downwardly 180° to the position shown in FIG. 2. When the front door 40 is swung down to its open position, a front drawer 46 can be partially slid out of the open 48 formed when the door 40 down. The front drawer 46 is positioned at a height 50 above the ground 27 to provide a convenient height for supporting the keyboard of a computer system which may or may not include the central processing unit (CPU) and tape or disk interface components.

A side drawer assembly 52 is provided in the right side 32 of the enclosure 30 to support computer components such as printers, modems, auxillary tape and disk interface modules as well as software, documentation, and manuals. The assembly 52 includes a right side wall 54 and a left side wall 56 which support a plurality of shelves 57, 58, and 59 therebetween. The assembly 52 is provided with castered rollers 60 for rolling support independent of the cabinet enclosure 30 on the ground 27 so that the assembly 52 remains stable no matter what its relative position to the cabinet enclosure 30. When in a closed position, as shown in FIG. 1, the right side wall 54 forms a large portion of the right side 32 of the cabinet enclosure 30 and when rolled out thereof, such as by manual application of force to an appropriate handle 62, the side drawer assembly 52 can be moved sidewise to the position shown in FIG. 2 and then rotated to the position shown in FIG. 3.

Figure 4:
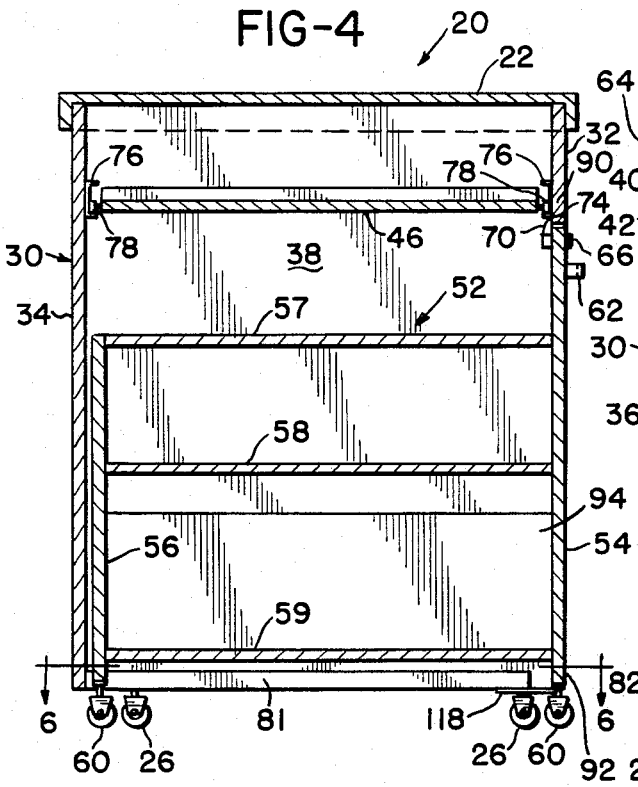
FIG. 4 is a front cross-sectional view taken on line 4—4 of FIG. 1.
Figure 5:
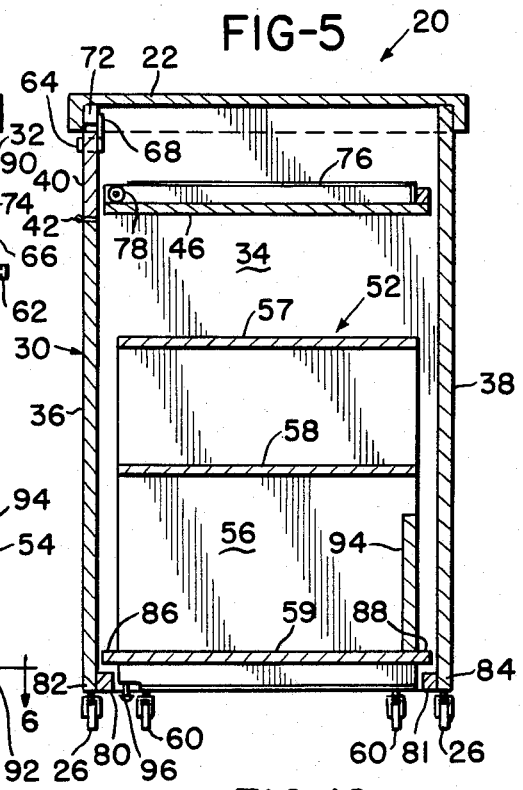
FIG. 5 is a side cross-sectional view taken on line 5—5 of FIG. 1.

The security of the cabinet 20 is maintained by providing a lock 64 on the door 40 to maintain its closed position when desired and a lock 66 on the right side wall 54 to maintain the side drawer assembly 52 in a closed position when that is desired. As shown in FIGS. 4 and 5, the locks 64 and 66 each include blocker members 68 and 70 respectively which are rotatable to provide locking engagement with adjacent portions 72 and 74 of the cabinet enclosure 30.

Figure 3:
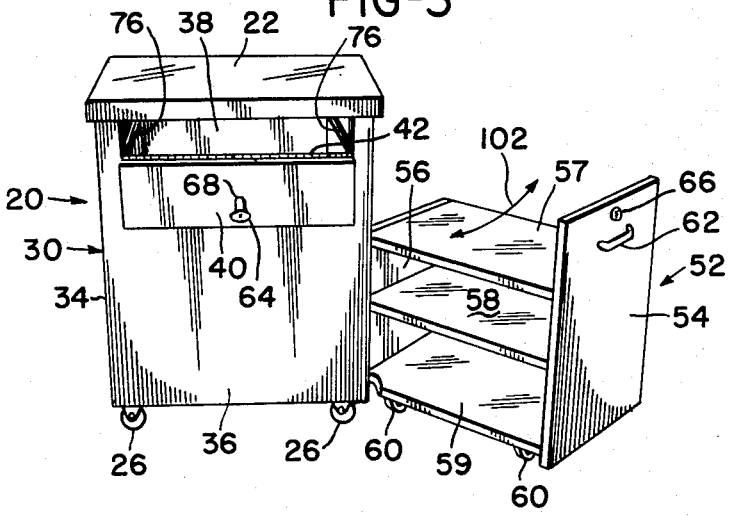
FIG. 3 is a front perspective view of the cabinet of FIGS. 1 and 2 with its front drawer removed and the side drawer assembly rotated to its normal in use position.

As shown in FIGS. 3, 4 and 5, the front drawer 76 is made slidable by suitable commercially available tracks 76 connected to the enclosure 30 and rollers 78 for engagement therewith positioned on the drawer 76.

Side drawer assembly supports 80 and 81 are positioned at the lower inner edges 82 and 84 of the front and rear enclosure sides 36 and 38 in positions to engage the front and rear edges 86 and 88 of the lower shelf 59 which may be slightly deeper than the shelves 57 and 58 as shown in FIG. 5. The supports 82 and 84 engage the edges 86 and 88 so that the cabinet 20 can be lifted as a unit thereby further ensuring the security thereof. Since the lock 64 is positioned at the upper edge 90 of the right side wall 54, it might be possible to overstress the side drawer assembly 52 by application of extreme outward force to the lower edge 92 thereof. This is prevented by providing a drawer brace 94 between the right and left side walls 54 and 56 adjacent the lower shelf 59.

Figure 8:
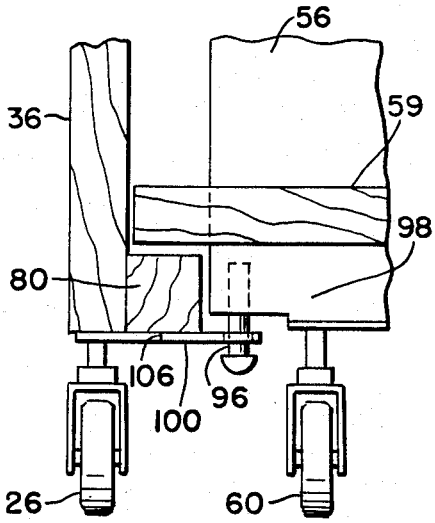
FIG. 8 is an enlarged front detailed view taken at line 8—8 in FIG. 7.
Figure 7:
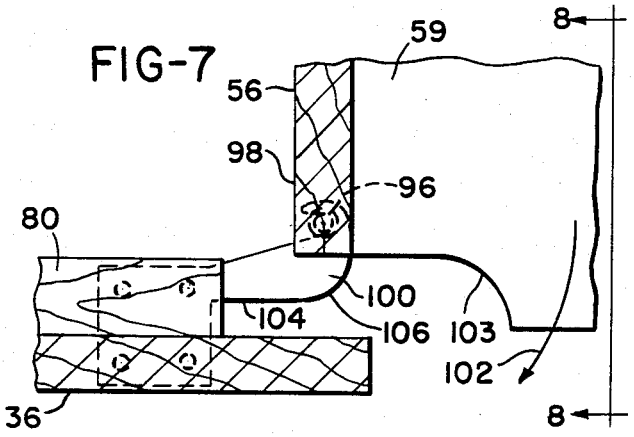
FIG. 7 is an enlarged detailed cross-sectional view taken at lines 7—7 in FIG. 2.
Figure 6:
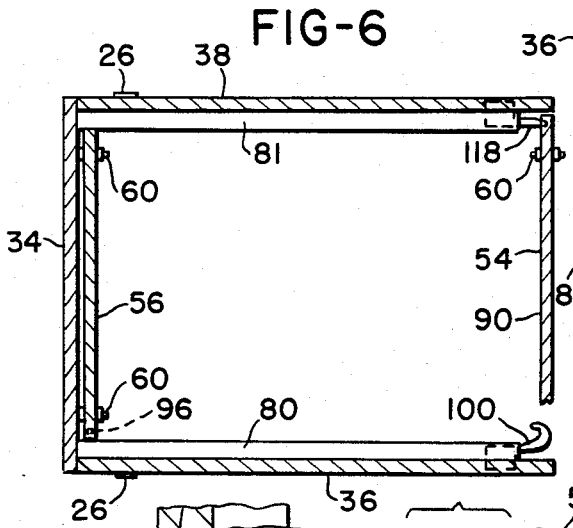
FIG. 6 is a top cross-sectional view taken at line 6—6 in FIG. 4.

As shown in FIG. 3, it is desirable that the side drawer assembly 52 swing with respect to the cabinet enclosure 32 without being detached therefrom. This is accomplished by providing a downwardly extending pivot pin 96 at the lower front 98 of the left side wall 56 in position to engage a pin hook 100 attached to the front side 36 of the cabinet 20 and to the support 80 as shown in FIGS. 6, 7, and 8. Since the rollers 60 are of the castering type, engagement of the pin 96 with the pivot hook 98 when the side drawer assembly 52 is withdrawn causes it to rotate in the direction of the arrow 102, shown in FIG. 3. A cutout 103 is provided in the edge 86 of the shelf 59 to provide clearance from the front side 36 when swung forwardly.

Figure 10:
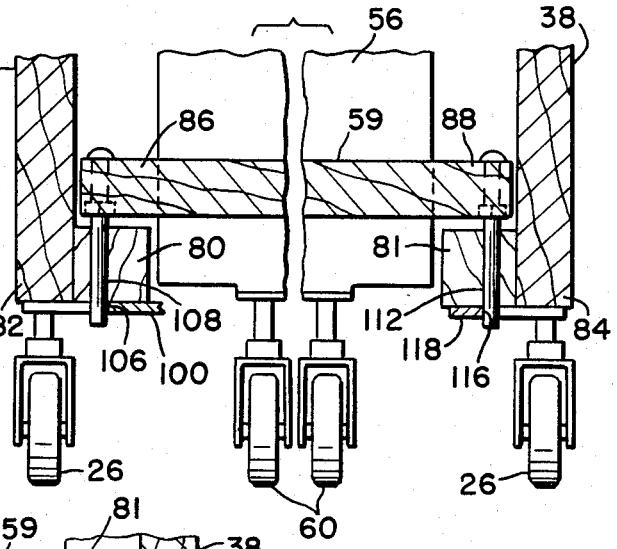
FIG. 10 is a detailed cross-sectional view taken at line 10—10 on FIG. 9.
Figure 9:
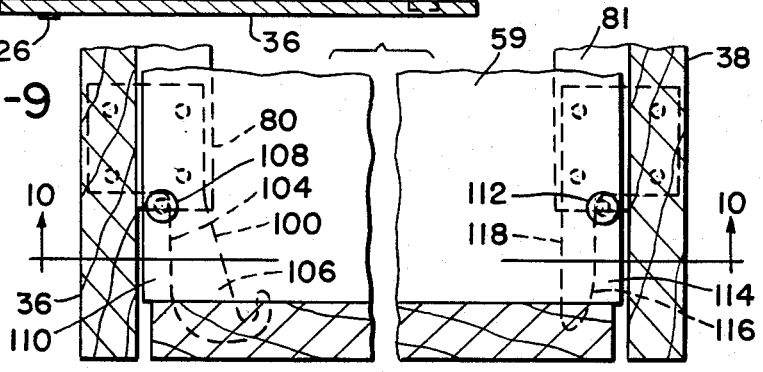
FIG. 9 is an enlarged detailed cross-sectional view taken at line 9—9 on FIG. 1.

The front side 104 of the pin hook 100 includes a cam surface 106 as shown in FIG. 9. The cam surface 106 is positioned to engage a pin 108 which extends downwardly from the shelf 59 at the front right corner 110 thereof as shown in FIG. 10. A second pin 112 extends from the rear right corner 114 of the shelf 59 to engage a similar cam surface 116 on a guide plate 118 supported to the rear support 81 and back side 38. When the pins 112 and 116 are fully engaged with the cam surfaces 106 and 116 respectively, the force required to pry the front and back cabinet sides 36 and 38 apart to allow at least partial access to the interior of the cabinet 20 is greatly increased thus assuring security of the cabinet 20.

Therefore there has been shown and described a novel cabinet for enclosing or supporting computer components and accessories in work positions which fulfills all of the objects and advantages sought therefor. Many changes, modifications, variations and other uses and applications of the subject invention will however become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

What is claimed is:

1. A combined work station and security cabinet for a computer system including:

a cabinet enclosure having connected:

a front wall;

a back wall;

first and second side walls, said first side wall defining an opening therein; and a top wall; and a side drawer assembly having:

an outer side wall positionable to fill said defined opening in said first side wall;

an inner side wall;

at least a first shelf positioned between said inner and outer side walls for supporting at least some of said computer system, said at least a first shelf having:

a front edge;

a first pivot pin extending downwardly from said inner side wall of said side drawer assembly adjacent said front edge of said at least a first shelf;

means to lock said side drawer assembly in position within said cabinet enclosure with said outer side wall filling said defined opening in said first side wall; and downwardly facing castering rollers out of engagement with said cabinet enclosure positioned to allow said side drawer assembly to be rolled out of said cabinet enclosure, said cabinet enclosure further including:

a first engagement member having:

a pin hook thereon positioned to engage said first pivot pin when said side drawer assembly is rolled out of said cabinet enclosure so that said side drawer assembly can swing about said hook through a predetermined angle.

2. The cabinet for a computer system as defined in claim 1 wherein said first pivot pin is vertically orientated.

3. The cabinet for a computer system as defined in claim 1 wherein said at least first shelf includes:

a back edge, wherein said side drawer assembly includes:

a first security pin extending from said front edge of said at least first shelf adjacent said outer side wall; and a second security pin extending from said back edge of said at least first shelf adjacent said outer side wall, wherein said first engagement member includes:

a cam surface thereon positioned to engage said first security pin when said outer side wall of said side drawer assembly is filling said defined opening in said first side wall, and wherein said cabinet enclosure includes:

a second engagement member including:

a cam surface thereon positioned to engage said second security pin when said outer side wall of said side drawer assembly is filling said defined opening in said first side wall whereby said first and second security pins and first and second engagement members resist spreading of said front and back walls of said cabinet enclosure when said outer side wall of said side drawer assembly is filling said defined opening in said first side wall.

4. The cabinet for a computer system as defined in claim 3 wherein said first and second security pins are vertically orientated.

5. The cabinet for a computer system as defined in claim 4 wherein said front wall includes:

a front support member positioned thereon below said at least first shelf positioned to engage said front edge thereof when said outer side wall of said side drawer assembly is filling said defined opening in said first side wall, and wherein said back wall includes:

a back support member positioned thereon below said at least first shelf positioned to engage said back edge thereof when said outer side wall of said side drawer assembly is filling said defined opening in said first side wall whereby said engagement of said front and back support members with said at least first shelf prevents vertical separation of said cabinet enclosure and said side drawer assembly.

6. The cabinet for a computer system as defined in claim 5 wherein said cam surfaces of said first and second engagement members face away from each other.

7. The cabinet for a computer system as defined in claim 5 wherein said cabinet enclosure front wall includes:

an opening defined therein having:

a lower edge;

hinge means connected to said lower edge of said defined opening; and a door positionable in said opening defined in said front wall, said door having:

a lower edge connected by said hinge means to said lower edge of said opening defined in said front wall; and means to lock said door in position within said front wall with said door filling said defined opening in said front wall.

8. The cabinet for a computer system as defined in claim 7 wherein said cabinet enclosure further includes:

a keyboard support drawer positioned to extend at least partially through said opening defined in said front wall when said door is not filling said opening defined in said front wall; and means to slidably support said keyboard support drawer for movement in said opening defined in said front wall.

9. A combined work station and security cabinet for a computer system including:

a cabinet enclosure having connected:

a front wall;

a back wall;

first and second side walls, said first side wall defining an opening therein; and a top wall; and a side drawer assembly having:

an outer side wall positionable to fill said defined opening in said first side wall;

an inner side wall;

at least a first shelf positioned between said inner and outer side walls for supporting at least some of said computer system, said at least a first shelf including:

a front edge; and a back edge;

means to lock said side drawer assembly in position within said cabinet enclosure with said outer side wall filling said defined opening in said first side wall;

downwardly facing castering rollers out of engagement with said cabinet enclosure positioned to allow said side drawer assembly to be rolled out of said cabinet enclosure;

a first security pin extending from said front edge of said at least first shelf adjacent said outer side wall; and a second security pin extending from said back edge of said at least first shelf adjacent said outer side wall, said cabinet enclosure further including:

a first engagement member including:

a cam surface thereon positioned to engage said first security pin when said outer side wall of said side drawer assembly is filling said defined opening in said first side wall; and a second engagement member including:

a cam surface thereon positioned to engage said second security pin when said outer side wall of said side drawer assembly is filling said defined opening in said first side wall whereby said first and second security pins and first and second engagement members resist spreading of said front and back walls of said cabinet enclosure when said outer side wall of said side drawer assembly is filling said defined opening in said first side wall.

10. The cabinet for a computer system as defined in claim 9 wherein said said first and second security pins are vertically orientated.

11. The cabinet for a computer system as defined in claim 9 wherein said front wall includes:

a front support member positioned thereon below said at least first shelf positioned to engage said front edge thereof when said outer side wall of said side drawer assembly is filling said defined opening in said first side wall, and wherein said back wall includes:

a back support member positioned thereon below said at least first shelf positioned to engage said back edge thereof when said outer side wall of said side drawer assembly is filling said defined opening in said first side wall whereby said engagement of said front and back support members with said at least first shelf prevents vertical separation of said cabinet enclosure and said side drawer assembly.

12. The cabinet for a computer system as defined in claim 9 wherein said cam surfaces of said first and second engagement members face away from each other.

13. The cabinet for a computer system as defined in claim 12 wherein said side drawer assembly includes:

a second shelf positioned above said at least first shelf extending between said inner and outer side walls, said second shelf being narrower than said at least first shelf.

14. A combined work station and security cabinet for a computer system including:

a cabinet enclosure having connected:

a front wall;

a first engagement member connected to said front wall;

a back wall;

first and second side walls, said first side wall defining an opening therein; and a top wall; and a side drawer assembly having:

an outer side wall positionable to fill said defined opening in said first side wall;

an inner side wall;

at least a first shelf positioned between said inner and outer side walls for supporting at least some of said computer system, said at least first shelf including:

a front edge; and a back edge;

means to lock said side drawer assembly in position within said cabinet enclosure with said outer side wall filling said defined opening in said first side wall;

downwardly facing castering rollers out of engagement with said cabinet enclosure positioned to allow said side drawer assembly to be rolled out of said cabinet enclosure;

a first security pin extending from said front edge of said at least first shelf adjacent said outer side wall; and a second security pin extending from said back edge of said at least first shelf adjacent said outer side wall, said first engagement member including:

a cam surface thereon positioned to engage said first security pin when said outer side wall of said side drawer assembly is filling said defined opening in said first side wall, and said cabinet enclosure further including:

a second engagement member including:

a cam surface thereon positioned to engage said second security pin when said outer side wall of said side drawer assembly is filling said defined opening in said first side wall, whereby said first and second security pins and first and second engagement members resist spreading of said front and back walls of said cabinet enclosure when said outer side wall of said side drawer assembly is filling said defined opening in said first side wall.

15. The cabinet for a computer system as defined in claim 14 wherein said said first and second security pins are vertically orientated.

16. The cabinet for a computer system as defined in claim 14 wherein said front wall includes:

a front support member positioned thereon below said at least first shelf positioned to engage said front edge thereof when said outer side wall of said side drawer assembly is filling said defined opening in said first side wall, and wherein said back wall includes:

a back support member positioned thereon below said at least first shelf positioned to engage said back edge thereof when said outer side wall of said side drawer assembly is filling said defined opening in said first side wall, whereby said engagement of said front and back support members with said at least first shelf prevents vertical separation of said cabinet enclosure and said side drawer assembly.

17. The cabinet for a computer system as defined in claim 16 wherein said cam surfaces of said first and second engagement members face away from each other.

18. The cabinet for a computer system as defined in claim 16 wherein said cabinet enclosure front wall includes:

an opening defined therein having:

a lower edge;

hinge means connected to said lower edge of said defined opening; and a door positionable in said opening defined in said front wall, said door having:

a lower edge connected by said hinge means to said lower edge of said opening defined in said front wall; and means to lock said door in position within said front wall with said door filling said defined opening in said front wall.

19. The cabinet for a computer system as defined in claim 18 wherein said cabinet enclosure further includes:

a keyboard support drawer positioned to extend at least partially through said opening defined in said front wall when said door is not filling said opening defined in said front wall; and means to slideably support said keyboard support drawer for movement in said opening defined in said front wall.

* * * * *